US006170201B1

(12) United States Patent
Mason et al.

(10) Patent No.: US 6,170,201 B1
(45) **Date of Patent: *Jan. 9, 2001**

(54) INSULATED BURIAL VAULT

(76) Inventors: George E. Mason, P.O. Box 409, Davidsville, PA (US) 15935; Mark E. Holsopple, 103 E. County Line Rd. Apt. 1, Syracuse, IN (US) 46567

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/927,020

(22) Filed: Sep. 10, 1997

Related U.S. Application Data

(60) Provisional application No. 60/025,727, filed on Sep. 10, 1996.

(51) Int. Cl.[7] ..... E04H 13/00

(52) U.S. Cl. ..... 52/136; 52/741.11; 52/741.12; 27/35

(58) Field of Search ..... 52/128, 139–142, 52/136, 741.11, 741.12; 27/26–30, 35

(56) References Cited

U.S. PATENT DOCUMENTS

| | | | | |
|---|---|---|---|---|
| 2,806,278 | | 9/1957 | Crump . | |
| 2,848,780 | | 8/1958 | Gosnell . | |
| 2,974,390 | | 3/1961 | Nelson . | |
| 3,159,901 | | 12/1964 | Harrington et al. . | |
| 3,164,880 | | 1/1965 | Hotchkiss . | |
| 3,172,183 | | 3/1965 | Bugg . | |
| 3,230,674 | * | 1/1966 | Christensen | 27/7 |
| 3,283,386 | | 11/1966 | Cenegy . | |
| 3,406,229 | | 10/1968 | Cenegy . | |
| 3,439,461 | * | 4/1969 | Chandler et al. | 27/7 |
| 3,464,171 | * | 9/1969 | Chandler et al. | 27/7 |
| 3,541,747 | | 11/1970 | Olson et al. . | |
| 3,545,055 | | 12/1970 | Pare . | |
| 3,878,657 | * | 4/1975 | Ferver | 52/139 |
| 4,044,435 | | 8/1977 | Acton . | |
| 4,261,083 | * | 4/1981 | Darby et al. | 27/35 |
| 4,759,105 | | 7/1988 | Buerosse . | |
| 4,800,631 | | 1/1989 | Pellmann . | |
| 4,924,565 | | 5/1990 | Rathjen . | |
| 5,121,529 | * | 6/1992 | McClure | 27/7 |
| 5,321,873 | | 6/1994 | Goria . | |
| 5,485,661 | | 1/1996 | McClure . | |
| 5,568,677 | | 10/1996 | Tobin . | |

* cited by examiner

*Primary Examiner*—Beth A. Stephan
(74) *Attorney, Agent, or Firm*—Banner & Witcoff, Ltd.

(57) ABSTRACT

A hermetically sealed, insulated, fiberglass and/or polymeric burial vault. The burial vault may include inner and outer layers with an insulation material there between. Additionally, an anchor or other device may be utilized to hold the burial vault in the ground.

6 Claims, 10 Drawing Sheets

INSULATED BURIAL VAULT

The present application is a continuation of copending provisional application Ser. No. 60/025,727 entitled "MULTILAYER FIBERGLASS BURIAL VAULT" filed on Sep. 10, 1996.

FIELD OF THE INVENTION

The invention relates to burial vaults generally and, in particular, to burial vaults suitable for interment in the ground and sized for receiving a casket containing a cadaver, and methods of manufacture and use thereof.

DESCRIPTION OF THE RELATED ART

Various burial vaults are known, including burial vaults formed from wood, concrete, metal, and fiberglass. See, for example, U.S. Pat. No. 3,159,901 issued to A. C. Harrington, et. al. on Dec. 8, 1964. However, burial vaults formed of wood may float to the surface. Other burial vaults such as those formed of concrete are often built to be extremely heavy, either due to the weight of materials used or due to requirements for structural strength (e.g., having thick burial vault walls). Such heavy burial vaults cannot be easily or safely handled or manipulated by a single person, and often a crane or other similar device suitable for manipulating heavy objects must be located at a burial spot for positioning the burial vault into the ground.

Furthermore, conventional burial vaults typically do not provide an extremely reliable and/or efficient hermetic seal at a cost effective price over an extended period of time. For example, wood and concrete are both porous materials and so a burial vault made of one of these materials may allow moisture to conduct through the walls of the burial vault. Such moisture, if allowed to reach a casket and/or a cadaver contained within a casket, will accelerate deterioration of the casket and/or the cadaver. Condensation within the grave tends to accumulate when a conventional burial vault is used, and such condensation can corrode or rot the conventional burial vault. If this happens, dangerous contaminants may escape from the burial vault into the surrounding earth, and/or contaminants may enter the burial vault and accelerate the deterioration of the cadaver therein. In addition, temperature variations and oxygen expedite the deterioration process of the cadaver. Building a casket to be water tight, air tight, and insulated from temperature variations can be a very expensive endeavor as compared with building a burial vault to be hermetically sealed. This is because a casket is designed for presentation of the cadaver, and thus it often has a separate hinged lid for display of the cadaver and is often made of materials in such a manner so as to be as aesthetic and tasteful as possible. For example, it is difficult and expensive to built a hermetically-sealed casket that has a hinged lid.

SUMMARY OF THE INVENTION

An object of one or more aspects of the invention is to provide an improved burial vault structure which solves one or more of the above problems.

In some aspects of the invention, a burial vault provides an extremely reliable and/or efficient hermetic seal at a cost effective price over an extended period of time.

In further aspects of the invention, the burial vault is designed to prevent or reduce moisture from conducting through its walls, thus preventing or reducing detrimental excess moisture and/or condensation from accumulating in the grave and/or within the burial vault itself.

In further aspects of the invention, the burial vault is constructed to be of considerably less weight than a typical conventional burial vault. This feature allows the burial vault to be easy to handle by even one person, including handling in transporting and lowering the burial vault into the earth. Furthermore, there is no need for a lot of handling equipment such as a crane or a boom.

In some aspects of the invention, the burial vault is constructed using inner and outer layers made of a polymer material with an insulation material disposed there between. These aspects allow for temperature stability within the vault and a casket therein. Thus, the cadaver within the casket is preserved for a longer period of time than with conventional burial vaults. Furthermore, such a construction provides for a durable burial vault that is resistant to the elements and which will not to corrode or rot. Also, such a construction prevents contaminants from escaping and/or entering the burial vault.

In further aspects of the invention, an anchor extending either horizontally or vertically from the burial vault may anchor the burial vault into the ground.

In additional aspects of the invention, the burial vault may have slanted walls such that the burial vaults may be stackable so that they are able to be stored one on top of the other in a small area.

In yet further aspects of the invention, the burial vaults include a separate weight material sufficient to prevent the burial vault from coming out of the ground.

In further aspects of the invention, the burial vault is constructed to be durable and structurally strong. Strength and durability allows the burial vault to stand up to the test of time and to withstand the weight of earth and equipment that may be above the vault once it is buried.

BRIEF DESCRIPTION OF THE DRAWINGS

FIG. 5(*a*) is an detailed view of a seal which may be present in the base section of an exemplary burial vault in accordance with aspects of the invention.

FIG. 6(*a*) is a detailed view of a seal which may be present in the cover section of an exemplary burial vault in accordance with aspects of the invention.

FIG. 7(*b*) illustrates a second exemplary anchor in accordance with aspects of the invention.

FIG. 7(*c*) shows a perspective view of a jack.

FIG. 8(*b*) is a cross-sectional view of an exemplary base section and cover section in accordance with aspects of the invention.

FIG. 9(*b*) is a cross-sectional view of exemplary molds that may be used to create the outer layer of the base section in accordance with aspects of the invention.

DETAILED DESCRIPTION OF PREFERRED EMBODIMENTS

Figure 1:
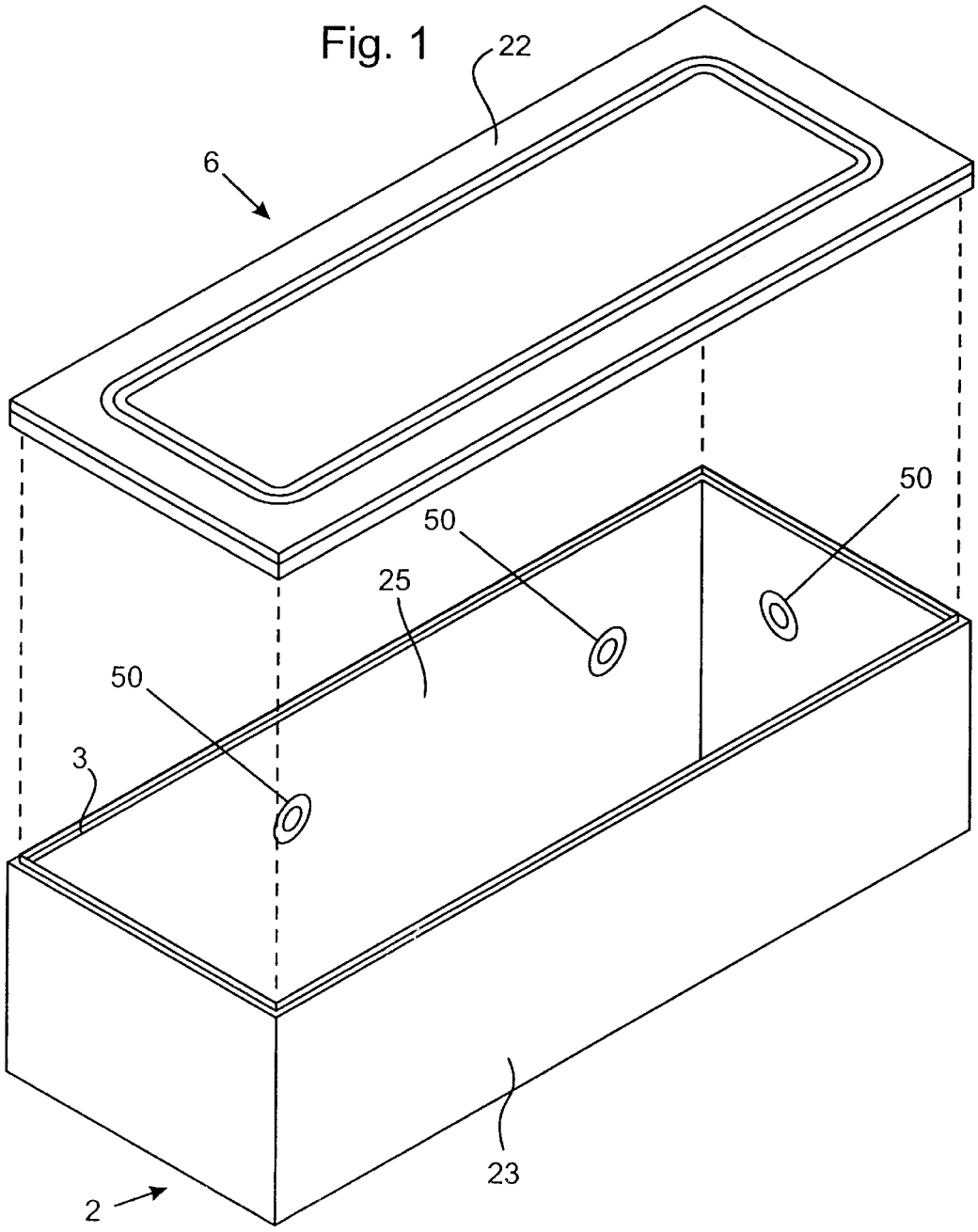
FIG. 1 is a perspective view of an exemplary burial vault in accordance with aspects of the invention.
Figure 3:
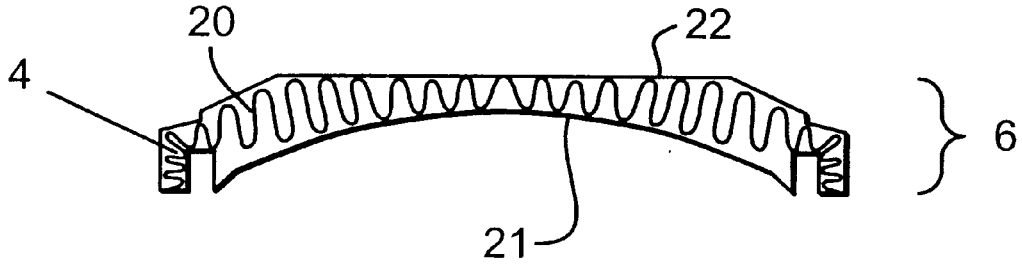
FIG. 3 is a cross-sectional view of a cover section of an exemplary burial vault in accordance with aspects of the invention.
Figure 4:
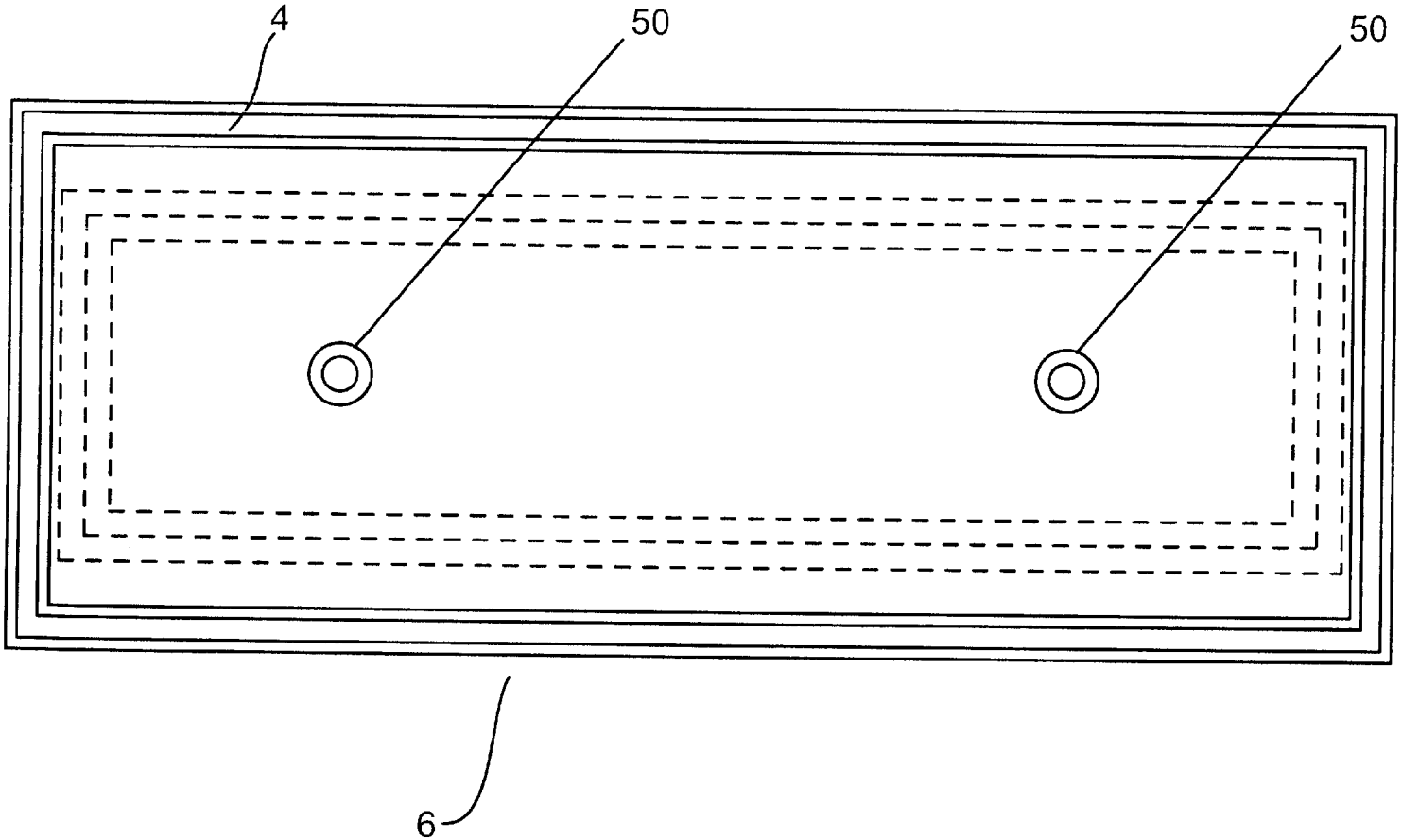
FIG. 4 is a bottom view of the cover section of an exemplary burial vault in accordance with aspects of the invention.

Referring to FIG. 1, a burial vault 1 includes a base section 2 which is preferably sized to receive a casket containing a cadaver. A cover section 6 may be provided to seal the base section 2, preferably with a hermetic seal. The base section 2 may include a raised ridge or beveled end 3 which mates with a groove or channel 4 (an exemplary or channel 4 is shown in FIGS. 3 and 4) disposed in the cover section 6, e.g., in a tongue-and-grove arrangement when the cover section 6 is closed against the base section 2. The base section 2 may be sealed to the cover section using any suitable non-hardening adhesive such as Sikaflex or any other well-known sealant. Furthermore, the base section 2 may include an inner layer 25 and/or an outer layer 23, and/or the cover section 6 may include an inner layer 21 (not shown in FIG. 1) and/or an outer layer 22. In some embodiments, the base section 2 may include a hole or plurality of holes 50 formed on the inner layer 25 and/or the outer layer 23. In the most preferred embodiments, the holes 50 are formed in the inner layer 25. Placing the holes on the inner layer provides increased reliability of the hermetic seal. In further embodiments, the cover section 6 may additionally or alternatively include a hole or plurality of holes 50 (not shown in FIG. 1) formed on the inner layer 21 (not shown in FIG. 1) and/or the outer layer 22. Again, it may be desirable to form the holes in the inner layer 21 for reliability reasons.

Figure 2:
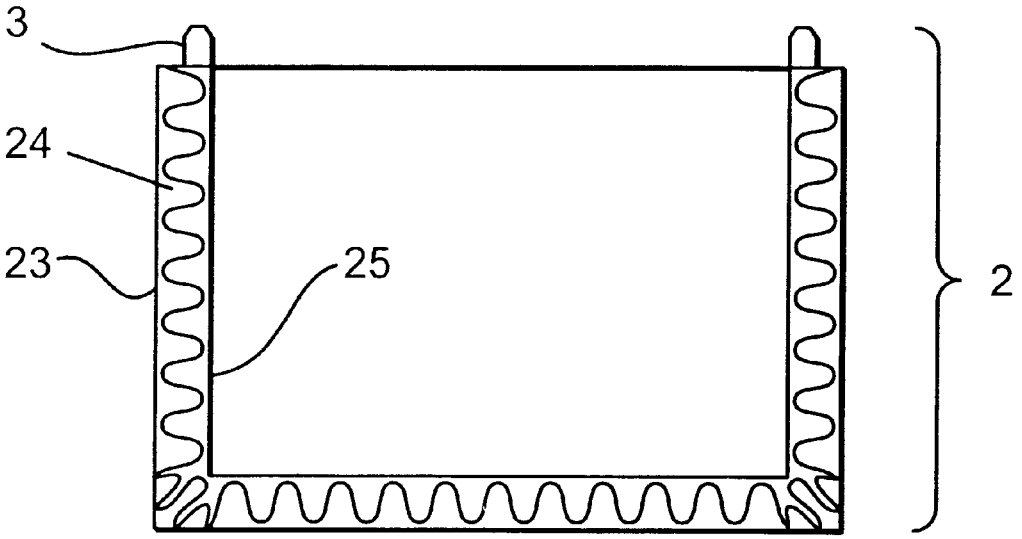
FIG. 2 is a cross-sectional view of a base section of an exemplary burial vault in accordance with aspects of the invention.

Referring to FIG. 2, the base section 2 may comprise the inner and outer layers 25, 23 sandwiching a layer of insulation material 24 there between. The inner and outer layers may be formed of fiberglass. Alternatively, the inner and outer layers may be formed using any suitable resin or polymeric material with sufficient rigidity to withstand the pressures from the earth and heavy equipment passing there over. For example, the inner and outer layer may be formed from any resin and/or other polymeric material such as polyoleofins, polyesters, polyamides, polyurethanes, polysulfones, and fluoropolymers such as polyvinylidene fluoride, polytetrafluoroethylene (PTFE), and perfluoroalkoxy resins (PFA). The resin or polymeric material may be utilized alone or in combination each other and/or in combination with other fibrous materials such as glass, metal, quartz, or polymeric fibers. The fibers may be woven or non woven.

The insulation material may be any commonly used insulation material. For example, the insulation material may be formed from any resin and/or other polymeric material such as a closed or open cell foam (which may be injected as a liquid) and/or other insulating materials. In exemplary embodiments, the insulation material may be formed from polymers such as polyoleofins, polyesters, polyamides, polyurethanes, polysulfones, and fluoropolymers such as polyvinylidene fluoride, polytetrafluoroethylene (PTFE), and perfluoroalkoxy resins (PFA). In one preferred embodiment, the support plate comprises a liquid injected into the burial vault which therafter forms a foam after curing.

In alternate embodiments, the insulation may be a cellulose material such as wood, cardboard, paper, and/or wood fibers. However a wood based cellulose product may be subject to deterioration over time.

Any or all of the inner and/or outer layers 21, 22, 23, 25 may be made of any polymeric material, for example, fiberglass or any well-known plastics, or any combination thereof Such polymeric materials are often relatively lightweight as compared with, for example, concrete, metal, or wood. Such polymeric materials also typically do not conduct moisture and/or air when implemented using an appropriate thickness. The inner and/or outer layers may be formed to be of any thickness, but preferably about ⅛ of an inch or more in thickness. This choice of thickness results in a good compromise of overall weight and structural integrity and strength of the vault 1. Of course, the actual thickness required Furthermore, the inner and outer layers need not be the same thickness throughout each layer or as compared with each other. In some embodiments, some or all outer layers may be thicker and/or thinner than corresponding inner layers. In alternate, less preferred embodiments, the thickness of one or both layers in the base section 2 and/or the cover section 6 may vary by as much as 10%, 20%, or 30% while still maintaining the structural integrity of the burial vault 1.

The insulation material 20, 24 is preferably about 2 inches in thickness and may be formed of a foam material, a solid material, a liquid material which cures into a foam or solid material, or any suitable insulation material and/or substance such as a polyurethane material or a cellulose material such as wood or cardboard, or any combination thereof If a liquid material is used, the liquid material may expand while curing, although it is preferable that such expansion is minimal and/or insignificant. In some embodiments, the thickness of the insulation may vary throughout by as much as about 10%, 20%, or 30%. In further embodiments, some or all of the insulation material 20, 24 may be divided into compartments. For example, each of the five sides or walls of the exemplary base section 2 illustrated in FIG. 1 may be individually insulated. Furthermore, each compartment and/or set of compartments may use a different set of materials and/or substances as insulation material.

In still further embodiments, an interior space between the inner and outer layers may be filled with concrete, sand, beads, crushed rock, gravel, or other material. The use of a heavy filling material helps prevent the burial vault from floating to the surface. However, if the filling material is placed into the burial vault prior to placing the vault in the grave, handling of the burial vault may not be optimal. Accordingly, it may be desirable to include a filling mechanism such as a funnel or other device which fills the space between the inner and outer layers after the burial vault has been placed in the grave. This may be done by pumping the filling material under pressure such as by pumping the concrete, sand, beads, crushed rock, gravel, or other material into one or more apertures in the burial vault such as hole 50. Alternatively, the filling material may be inserted into the interior space using a gravity such as by using a funnel system.

In one preferred embodiment, the inner and outer layers are formed of fiberglass and the insulation material is a liquid injected into the burial vault which therafter forms a foam after curing.

Figure 8A:
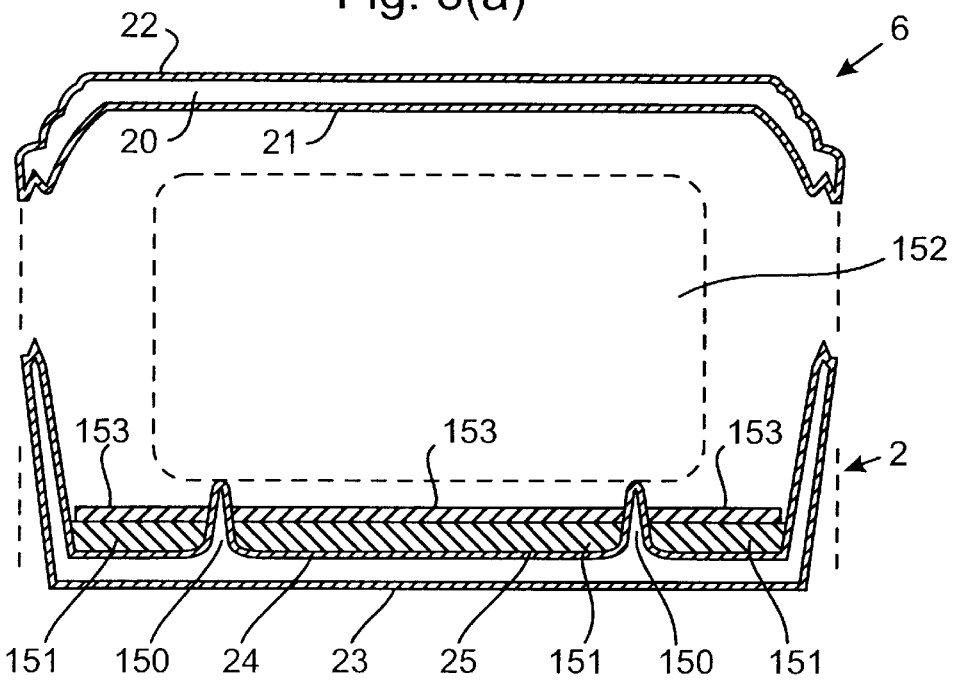
FIG. 8(*a*) is a cross-sectional view of an exemplary base section and cover section in accordance with aspects of the invention.
Figure 8B:
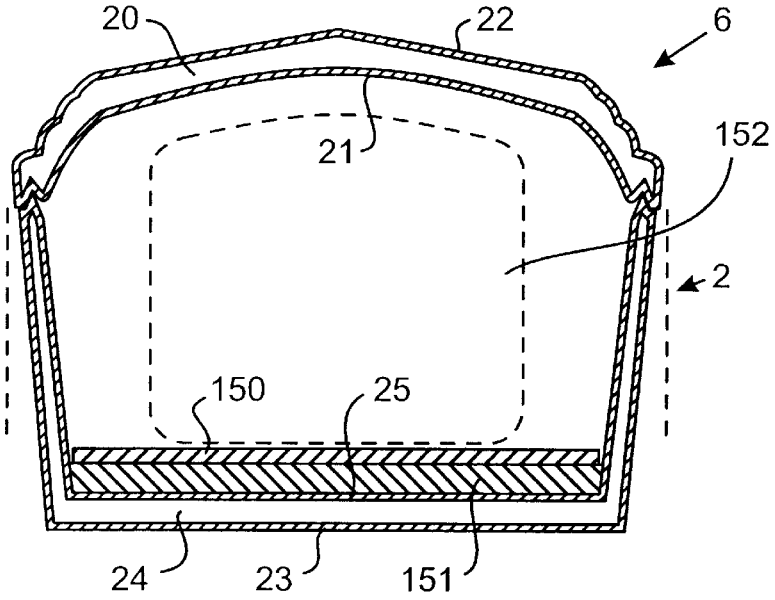

In further embodiments, the base section 2 and/or the cover section 6 may have a shape such that the base section 2 is vertically stackable with other identical base sections and/or the cover section 6 is vertically stackable with other identical cover sections. For example, as illustrated in FIGS. 8(*a*) and 8(*b*), the sides of the base section 2 may not be parallel and may partially converge towards the bottom of the base section 2. In this configuration, the floor or bottom wall of the base section 2 would have a lesser surface area than the opening at the top of the base section 2. Thus, the bottom of a base section 2 could be inserted into the top opening of another identical base section 2 to allow for space-efficient stacking. The space-efficient stacking and light weight contribute to allowing a plurality of burial vaults to be stacked in a small area and easily removed and transported by a single individual.

The burial vaults may be filled with the filling material after transportation to the local funeral home and prior to inserting in the earth. For example, where the burial vault is filled locally at the funeral home, it is more cost effective than transporting a heavy burial vault across the country which may weigh one ton or more and are conventionally not stackable.

After filling the burial vault with a filling material or insulation material, it may be desirable to seal any holes, apertures, or other openings to the interior space between the inner and outer layers using any well known sealer including polymeric, resins, and/or fiberglass materials.

Referring to FIG. 3, the cover section 6 may comprise inner and outer layers 21, 22 sandwiching an insulation material 20 there between. Although the cover section 6 may be variously configured, in the most preferred embodiments the cover section 6 is formed in generally an arch or dome-like shape. For example, the inner layer 21 may rounded or angular concave shape and the outer layer 22 may have a flat or stepped shape. This particular configuration provides added strength to the top of the burial vault 1 and provides a stackable cover section 6 and a pleasing appearance.

Referring to FIG. 4, in some embodiments of the cover section 6, a hole or plurality of holes 50 may be included on the inner layer 21 and/or the outer layer 22. Although the holes 50 may be of any size as long as the structural integrity of the burial vault 1 is maintained, the holes 50 are preferably about 3 inches or more in diameter and located on the inner layer to increase the reliability of the hermetic seal of the burial vault 1.

Figure 6A:
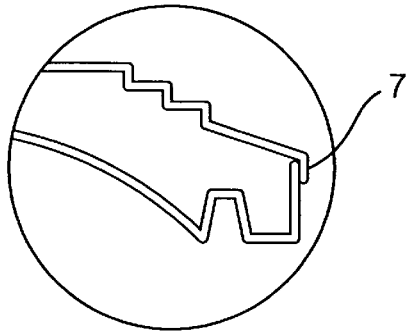
FIG. 6 is a cross-sectional view of a cover section of an exemplary burial vault in accordance with aspects of the invention.
Figure 6:
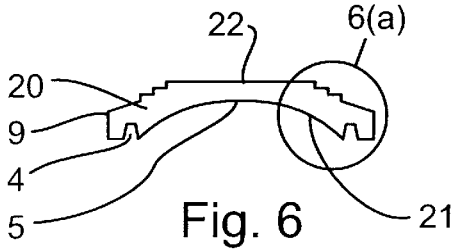
Figure 5:
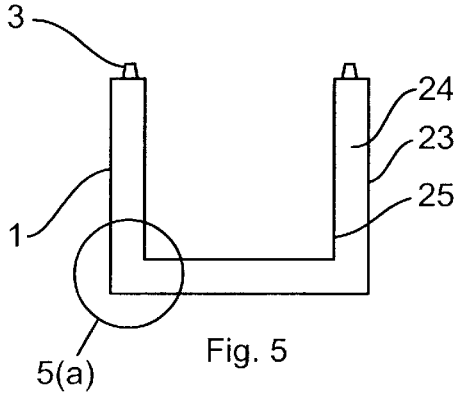
FIG. 5 is a cross-sectional view of a base section of an exemplary burial vault in accordance with aspects of the invention.
Figure 5A:
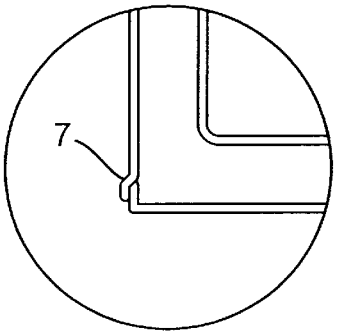

FIGS. 5 and 6 illustrate an alternative embodiment of the base section 2 and the cover section 6. In this embodiment, the inner and outer layers 25, 23 of the base section 2 and the inner and outer layers 21, 22 of the cover section 6 may be separate pieces. Alternatively, the inner and outer layers may form single unitary layers. Where the inner and outer layers of each section are multi-piece structures, it may be desirable to seal the inner and outer layers together. In these configurations, the inner and outer layers may be sealed together using any suitable sealing arrangement, e.g., an overlapping seal 7, as illustrated in FIGS. 5(*a*) and 6(*a*). In some embodiments, the cover section 6 and/or the base section 2 may include one or a plurality of overlapping seals 7. In further embodiments, the outer and inner layers of the base section 2 and/or the cover section 6 may be partially and/or hermetically sealed at the overlapping seal 7 using any suitable sealer, for example, Strantex. In further embodiments, the inner and outer layers may be sealed together using the same material as is used to form the inner and outer layers such as fiberglass, resin, or other polermeric material.

Figure 7A:
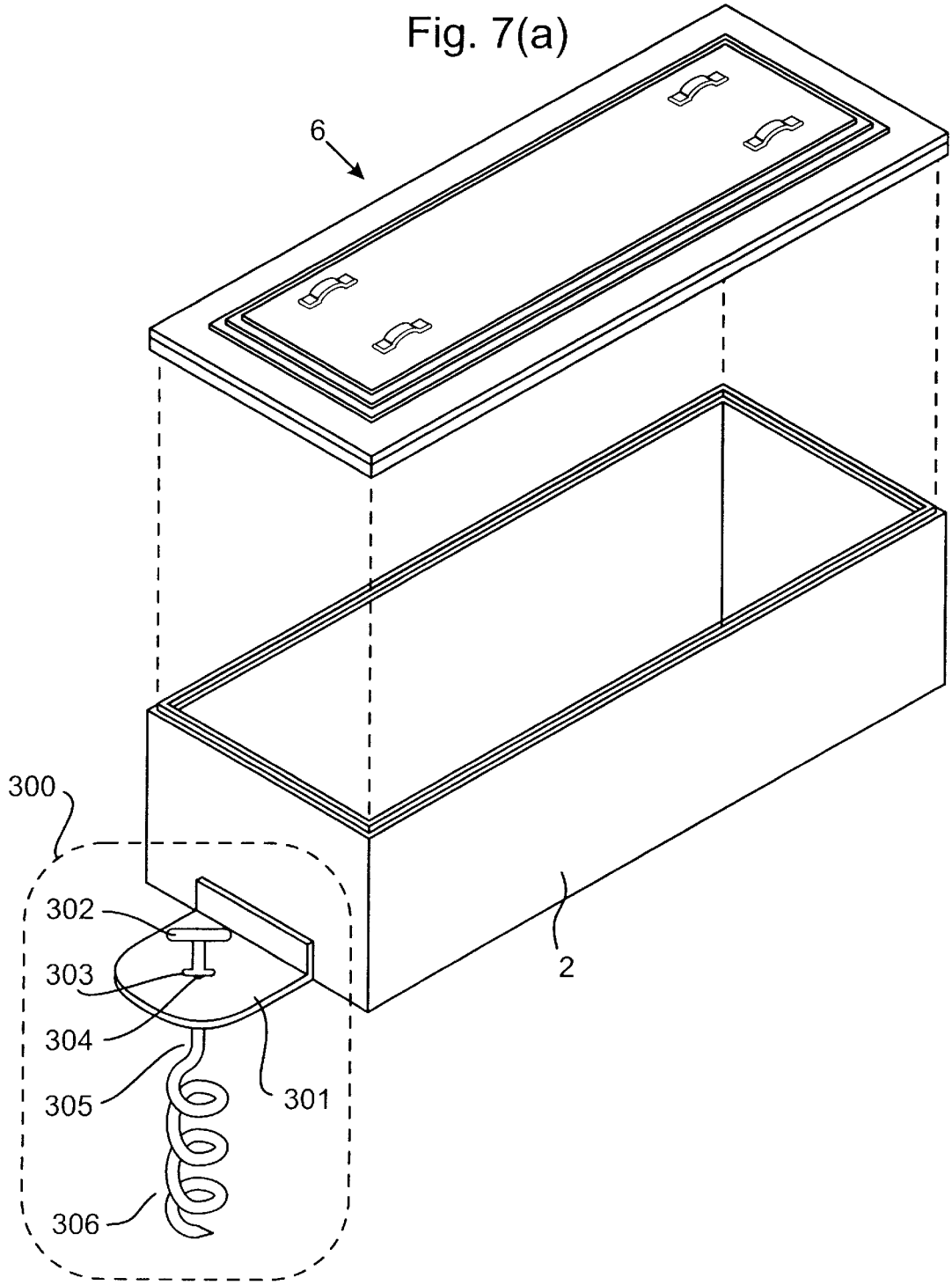
FIG. 7(*a*) illustrates a first exemplary anchor in accordance with aspects of the invention.
Figure 7B:
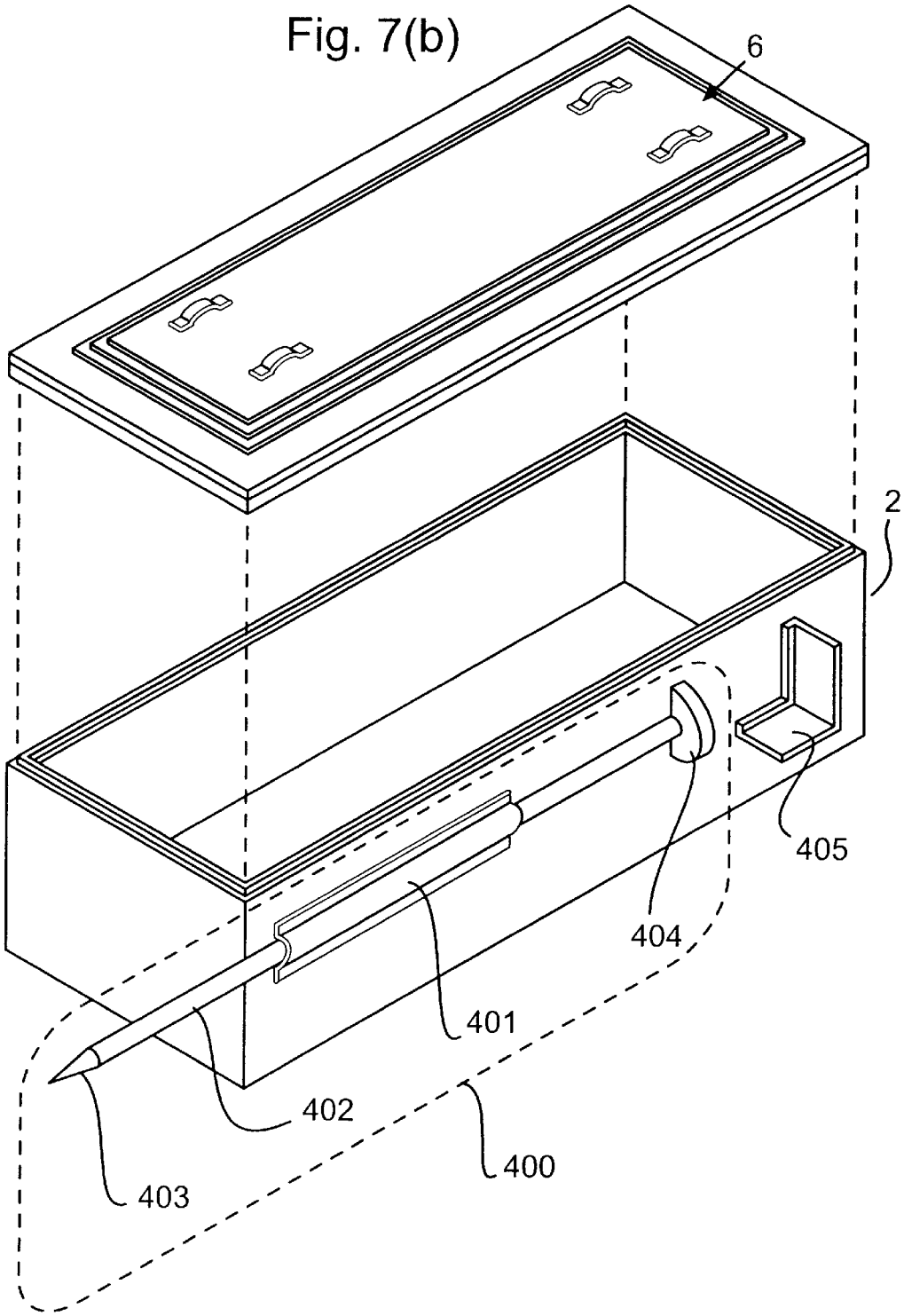

The burial vault according to one or more aspects of the invention may be relatively lightweight. In this event, it may be desirable to anchor or otherwise secure the burial vault to the earth to prevent the burial vault from floating up to the surface of the earth over time. Such an anchor may be necessary even though a casket with a cadaver therein is placed within the burial vault. Referring to FIG. 7(*a*), an exemplary anchor 300 may be used to secure a base section 2 to the earth. A bracket 301 may be attached to a side of the base section 2. Here, the bracket 301 is shown attached to a particular side, however, it may be attached to any part of any side or multiple sides. The bracket 301 may be secured to the base section 2 in any manner which does not destroy the sealing of the vault 1. For instance, the bracket 301 may be attached to the base section 2 using any well-known adhesive which can resist the elements or may be molded integrally with the outer layer of the base section 2. The bracket 301 may have a hole 304, and a tube or rod 305 may extending through the hole 304. The tube or rod 305 may have a lip, a washer, or other similar device 303 located above the hole 304 and which is larger than the diameter of the hole 304 for preventing the rod 305 from moving downward through the hole 304. The tube or rod 305 may have at its top end a handle, hexagonal shape, square shape, or slot, or other arrangement 302 which allows a tool for turning the tube or rod 305. For example, a hand tool, electric, and/or pneumatic device may be provided with the burial vaults to turn the tube or rod 305 by rotating the top end 302. Additionally, the person inserting the anchor may stand in the burial vault to add additional weight to force a lower section 306 into the ground as it is turned. Alternatively, the tool may include an extension such that it may be operated without entering the grave. In any event, it is preferable for the tool to be capable of being operated by a single person, preferably the person placing the burial vault into the ground. Further, the lower section 306 may be in the shape of a corkscrew or other spiral, helix, and/or screw shape. The lower section 306 is designed to be embedded into the earth below and should be shaped such that the lower section 306 seizes hold of or grips the earth once embedded therein. In this way, a vault 1 may be secured into the earth by turning the handle 302 until tight.

An anchoring arrangement which proceeds downward from the casket is advantageous since it is more space conservative in the horizontal direction than an anchor which extends horizontally. In this manner, the anchor allows close spacing of graves and anchors into dirt which has not been disturbed. A vertical anchor is therefor more likely to remain secure.

Figure 7C:
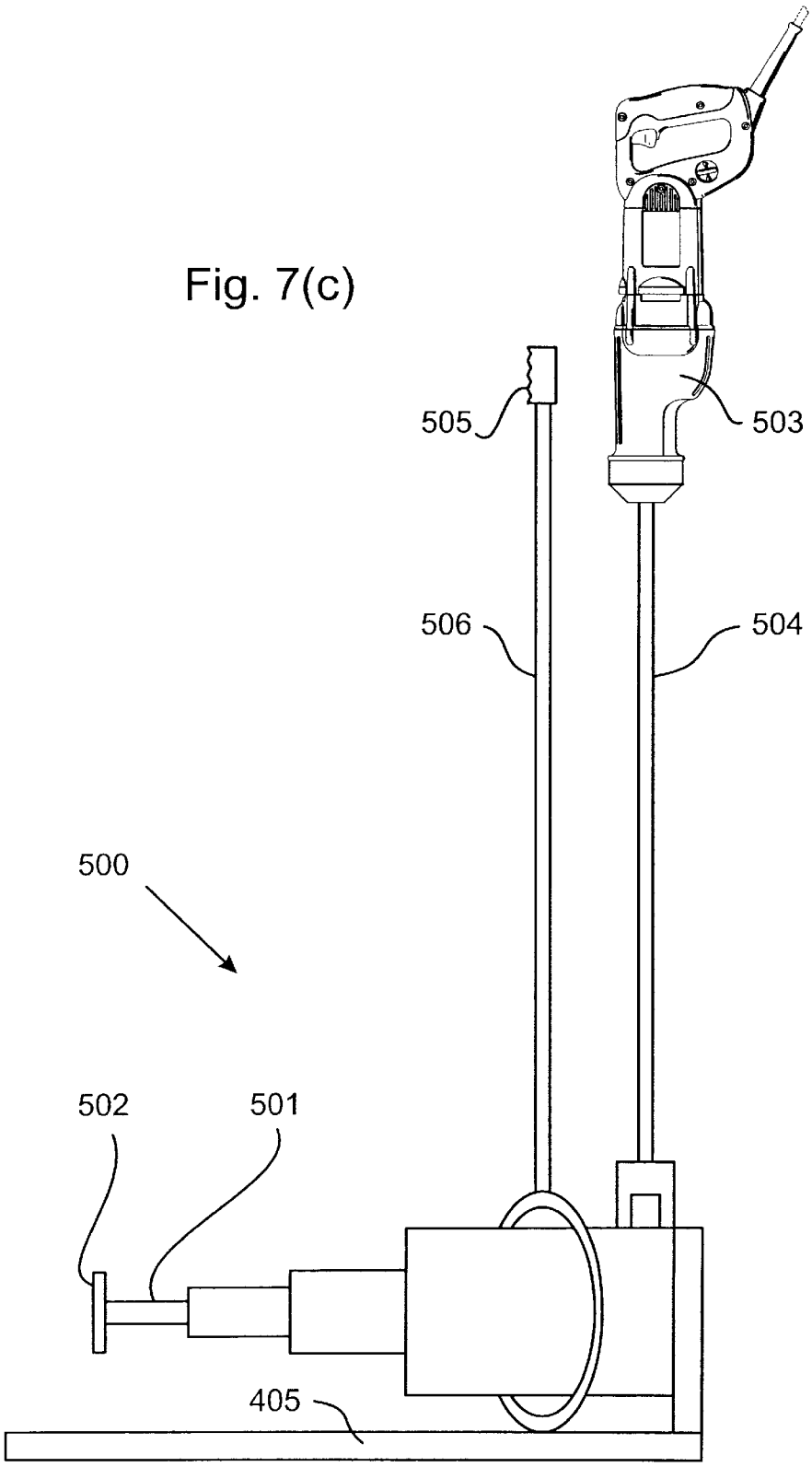

FIG. 7(*b*) illustrates an alternative embodiment of an anchor 400. A bracket 401 may be attached to a side of the base section 2. Here, the bracket 401 is shown attached to a particular side, however, it may be attached to any part of any side or multiple sides. The bracket 401 may be secured to the base section 2 in any manner which does not destroy the sealing of the vault 1. For instance, the bracket 401 may be attached to the base section 2 using any well-known adhesive which can resist the elements, or integrally molded into the outer layer 23 of the base section 2. The bracket 401 may have a slot or space through which a tube or rod 402 can be inserted. Ideally, the tube or rod 402 is no longer than the side of the base section 2 so that the base section having the anchor 400 may be easily lowered into the grave. The tube or rod 402 may have at one end a surface 404 which is designed to receive the blow of a hammer or other heavy tool or object. Alternatively, the end surface 404 may be disposed adjacent to a bracket 405 adhered and/or formed integrally with the base section 2. In this event, a jack 500 (See FIG. 7C) may be utilized to impale the tube or rod 403 into the ground. For example, the jack may be a hydraulic and/or mechanical jack.

As shown in FIG. 7*c*, the jack may include a handle 505 coupled to a rod to position the jack, one or more extension 501, a jack surface 502, and a means for moving the jack 503, 504 which may include a drill and an extension. Alternative means would be a hand operated handle, hydraulic pump, etc.

The tube or rod 402 may have at the other end a pointed section 403 designed to embed into the earth lateral to the grave. Thus, one may lower the base section 2 into the grave and then hammer and/or jack the surface 404 end of the tube such that the tube or rod 402 is embedded into the earth beginning with the pointed section 403. Alternatively, the pointed section 403 may be a corkscrew, helical, or other screw shape, and the surface 404 may be a handle, similar to those in the exemplary anchor 300. Any number of anchors attached to any location on a single base section 2 may be utilized for the purposes of securing the vault 1 to the earth.

In preferred embodiments, the anchor is formed of a non-corroding material such as stainless steel, brass, copper, aluminum, or other metalic alloys, and/or cement, ceramic, or polymeric materials.

As an alternative or in addition to using an anchor, sand, gravel, blocks and/or any other known heavy material 151 (FIG. 8) may be placed in the burial vault to increase the weight of the burial vault. The heavy material 151 may be inserted into the base section 2 after the burial vault 1 has been placed in the ground. Accordingly, it may be desirable to include a chamber or recess in the bottom of the burial vault 1 to accommodate the heavy material. Where weighting blocks are used, in exemplary embodiments, a plurality of sections of weighting blocks are utilized such that they can be easily handled by a single person. For example, the weighting blocks may be disposed in four approximately equal sections along the bottom of the burial vault.

The weight of the heavy material may be such that the total weight of the burial vault (after the casket and cadaver therein are inserted) is sufficient to increase the weight of the burial vault to prevent the vault from floating to the surface. The actual weight required will, of course, depend on the volume of the burial vault and the weight of the casket and cadaver. Using this method, enough material should be added to be sufficient to prevent the occurrence of floatation previously discussed. Thus, the burial vault would be lightweight during transport and handling, but heavy after being placed within the grave. It may be desirable to design the vault 1 such that the casket therein is sufficiently raised above the floor of the base section 2 to allow for the heavy material 151 to be added to the bottom of the base section 2. This may be accomplished by including a chamber at the bottom of the burial vault to receive the heavy material. The chamber may be variously configured. In some embodiments, the chamber may additionally be utilized to remove straps used to lower a casket 152 into the burial vault 1. For example, the casket 152 may be lowered into the base section 2 using straps which wrap underneath the casket, and the straps may then be easily removed from the casket after lowering. FIGS. 8(*a*) and 8(*b*) illustrate using bumps 150 to keep the casket sufficiently elevated above the floor of the base section. The bumps 150 include a single bump, any number of bumps, a flange, protrusion, or bar, ridge, wall, or other projection that may be used to form a chamber and/or elevate the casket 152. The bumps 150 may also be utilized to form the chamber to receive the heavy material.

Where the bumps 150 are formed in the in the burial vault 1, it may be desirable to angle the top surface of the bumps such that the heavy material flows into the chamber. A cover or other layer 153 may be included in the base section 2 to cover the heavy material and render a more pleasing appearance once the base section 2 has been installed. The cover 153 may be formed from one or more pieces of a fabric, sheet, section, or block of any suitable material such as the same material used to construct the inner and outer layers 23, 25. In the most preferred embodiments, the cover 153 may be configured to allow for bumps to remove the straps. The bumps 150 may be formed in the cover with the chamber disposed below the cover.

Figure 9A:
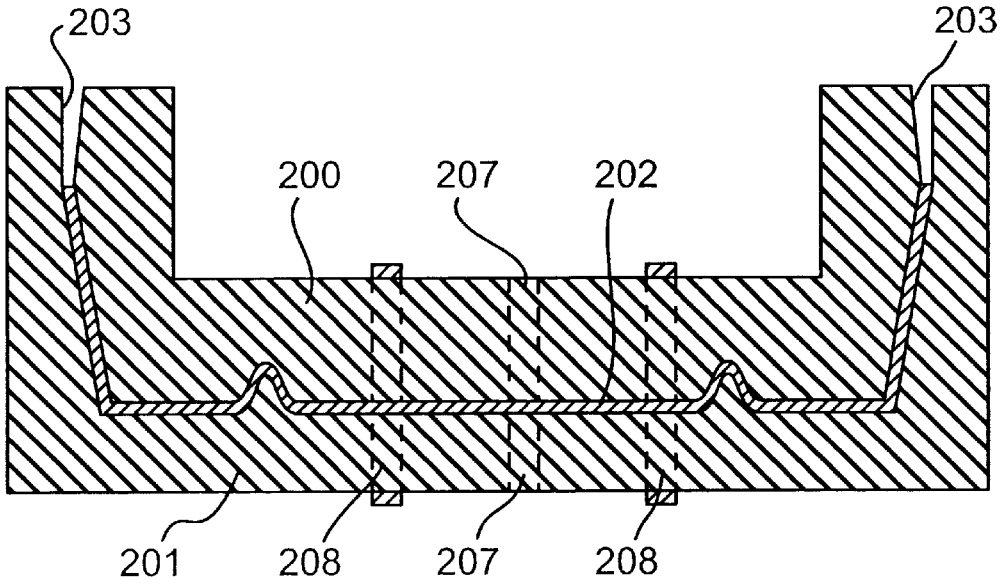
FIG. 9(*a*) is a cross-sectional view of exemplary molds that may be used to create the inner layer of the base section in accordance with aspects of the invention.
Figure 9B:
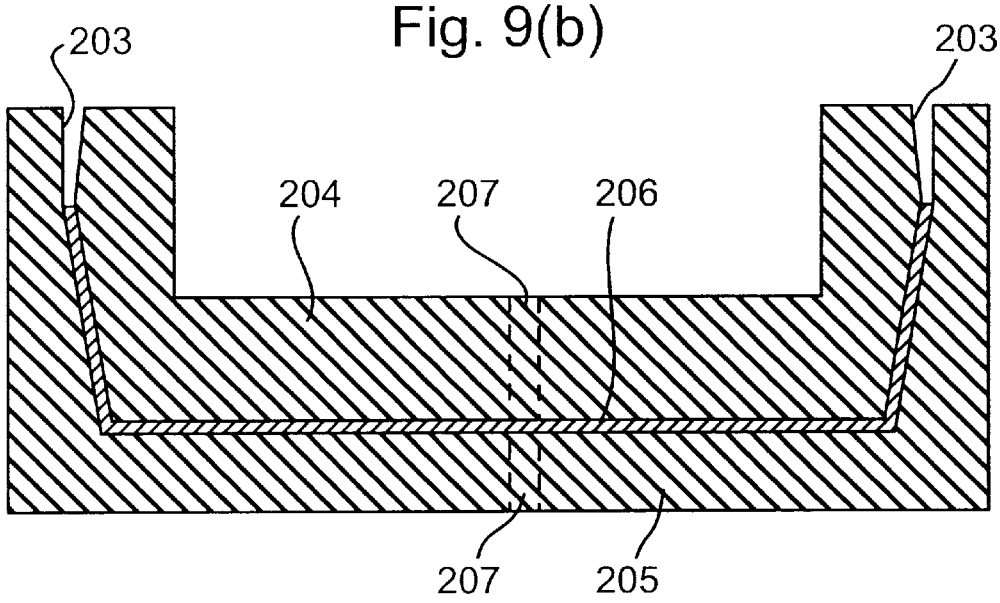

The vault 1 may be manufactured using any one or more well-known manufacturing techniques and/or a customized manufacturing technique described herein. Some or all of the inner and/or outer layers 21, 22, 23, 25 may be manufactured using molds. Thus, as illustrated in FIGS. 9(*a*), the inner layer 25 of the base section 2 may be manufactured by injecting a liquid material 202 through a hole or holes 203, 207 so that the liquid material settles between a first upper mold 200 and a first lower mold 201. Each mold 200, 201 is distanced from each other and shaped so that a layer of the appropriate shape and thickness is created once the liquid material cures to a hardened state. As illustrated in FIG. 9(*b*), the outer layer 23 of the base section 2 may be manufactured by pouring liquid material 206 between a second upper mold 204 and a second lower mold 205 which are pressed together. Each mold 204, 205 is distanced from each other and shaped so that a layer of the appropriate shape and thickness is created once the liquid material cures to a hardened state. These techniques may also be used in the same manner for the creation of the cover section 6.

Furthermore, some or all of the inner and outer layers may be bonded together. The inner and outer layers may be shaped so as to position the bond anywhere along the layers, but preferably the bond of the inner and outer layers 23, 25 of the base section 2 should be located at the rim where the base section 2 would contact the cover section 6 when the vault 1 is closed. A bond may be an overlapping seal 7, and/or it may include a raised bond (e.g., U or V shaped) that forms the raised ridge or beveled end 3 for mating with the groove or channel 4 in the cover section 6 when the vault 1 is closed. Placing the bond at the rim section allows for reinforcing the rim to accommodate the heavy load of earth and heavy machinery which passes over the grave after interment.

Once the inner and outer layers are bonded together, a shell of the base section 2 and/or the cover section 6 is formed. Thus, a shell includes an inner layer and its corresponding outer layer, with an empty space there between. Such a shell may be used with out any filling there between, or may be filled with the filling material or insulation material 20, 24 of the types described above to create the base section 2 and/or the cover section 6. Alternatively, the insulation material and/or filling materials may be inserted between the inner and outer layers prior to bonding the inner and outer layers together. The insulation material may be of a liquid and/or a foam material during the process of filling a shell, and the insulation material may cure into a more solid material after filling. In these configurations which implement a liquid or foam material, a shell may be filled by injecting or otherwise inserting the insulation material/filling material through the hole or holes 50 located in the inner and/or outer layers. Each hole 50 may be of any shape and size desired, so long as the structural integrity of the vault 1 is maintained. Preferably, however, the hole or holes 50 should be about 3 inches in diameter, thus being small enough to maintain the structural integrity of the vault 1, yet still allowing for convenient visual verification of the amount or level of insulation/filling material located between the inner and outer layers during the filling process. The use of multiple holes 50 may be helpful in ensuring that the material is evenly distributed within a shell. Alternatively, if the inner and outer layers have not been completely bonded together, the insulation material may be inserted through the opening or openings between the inner and outer layers where the bond would have been located. When filling a shell, each side of the shell may be separately filled with insulation material. Using this method, a shell may be oriented during the filling of each side such that the side being filled is substantially horizontal, such that the hole or holes 50, through which the insulation material is injected or inserted, are positioned on the top side of the shell to prevent leakage of the insulation material. In this way, a side of the shell may be filled completely. Once a side of the shell is filled, it may be helpful to allow the insulation material in that side to cure or harden before filling another side. Upon partially or completely filling a side or an entire shell with insulation material, some or all of the holes 50 may be capped or otherwise sealed by any well-known method, such as the methods discussed above.

Figure 10:
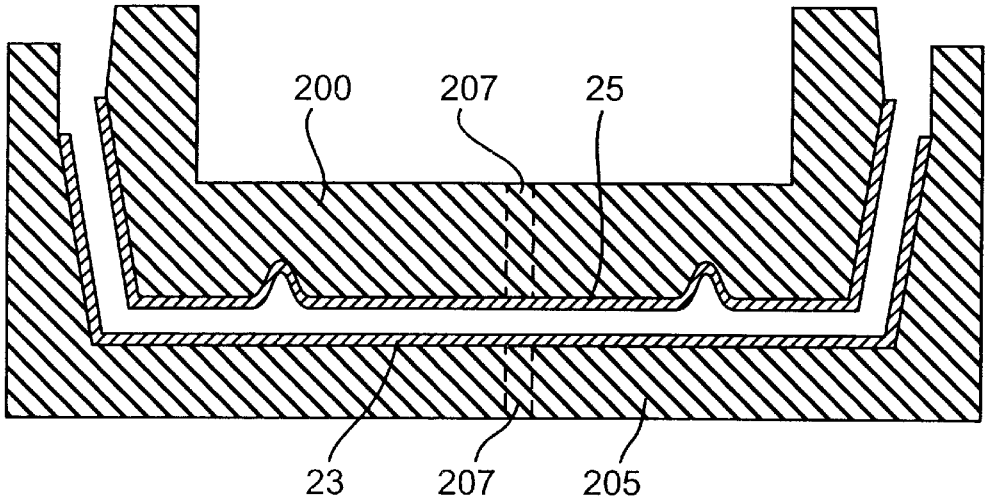
FIG. 10 is a cross-sectional view of exemplary molds that may be used for reinforcement of the inner and outer layers of the base section while filling with insulation material in accordance with aspects of the invention.

When filling a shell with material, it may be desirable to retain a mold or molds on the inner and/or outer layers to prevent or reduce deformation of the inner and/or outer layers from occurring during filling and/or curing of the material. Thus, for example, as illustrated in FIG. 10, when filling a shell to create the base section 2, the first upper mold 200 may be pressed against the completed inner layer 25 and the second lower mold 205 may be pressed against the completed outer layer 23. Furthermore, the first upper mold 200 and the second lower mold 205 may be attached together to allow for solid reinforcement of the inner and outer layers 25, 23 during filling. The first upper mold 200 and/or the second lower mold 205 may contain a removable mold section 208 which are configured create a hole or holes 50 in the inner and/or outer layers 25, 23. The removable mold section 208 may be removed to enable filling of the space between the layers 23, 25.

Where the filling and/or insulating material is a loose material such as a bead material, a binding material may be added to fix the material into place. Thus, material may be inserted between the inner and outer layers through such holes used by the removable mold section and through such holes 50. All techniques discussed for manufacturing and filling the base section 2 may also be used in the same manner for manufacturing and filling the cover section 6.

Using an alternative method of manufacture, a solid insulation material such as a cellulose, closed or open foam, filling material, or other material may be coated with a polymeric, resin, and/or fiberglass material such as discussed above with regard to the formation of the inner and outer layers. Using this method, the solid insulation/filling material becomes enclosed by a solid layer of material used to form layers 21, 22, 23, 25. The material coated on the inner side of the insulation/filling material thus forms the inner layer, and the material coated on the outer side of the insulation/filling material forms the outer layer. Using this method, it is not necessary to bond the inner and outer layers together, since they are already manufactured as a single physically continuous layer. The combination of the solid insulation/filling material and the outer coating (i.e., the inner and outer layers 21, 22, 23, 25) thus defines a base section 2 or a cover section 6.

While exemplary embodiments of a burial vault and exemplary methods of manufacturing a burial vault according to the present invention are shown and/or described, it will be understood, of course, that the invention is not limited to these exemplary embodiments and methods. Modifications may be made by those skilled in the art, particularly in light of the foregoing teachings. It is, therefore, intended that the appended claims cover any such modifications which incorporate the features of this invention or encompass the true spirit and scope of the invention. For example, each of the elements and/or steps of the aforementioned embodiments may be utilized alone or in combination with other elements and/or steps from other embodiments.

We claim:

1. A method of preventing a burial vault from floating to a surface of a grave over time, wherein the burial vault includes a base section having an inner layer and an outer layer with a space there between comprising the steps of:

lowering the burial vault into the grave and, after said lowering, adding material of sufficient weight so as to prevent said floating;

said addition of material including adding at least some of the material between the inner and outer layers of said burial vault.

2. The method of claim 1, wherein the inner and outer layers comprise fiberglass and a resin.

3. The method of claim 1, wherein the inner and outer layers are about ⅛ of an inch in thickness.

4. The method of claim 1, wherein the inner layer includes a hole.

5. The method of claim 1, wherein the burial vault includes a cover section and wherein the cover section has a second inner and outer layer with a second material disposed therebetween, the cover section being configured to fit over the base section so as to close the burial vault and allow the burial vault to be hermetically sealed from an environment that is outside the burial vault.

6. The burial vault according to claim 5, wherein the cover section is of domed shape.

* * * * *